US007100718B2

(12) United States Patent
Bancroft

(10) Patent No.: US 7,100,718 B2
(45) Date of Patent: Sep. 5, 2006

(54) ADJUSTABLE WHEELCHAIR

(75) Inventor: Peter John Bancroft, NSW (AU)

(73) Assignee: Baribunma Holdings Limited, Peakhurst NSW. (AU)

( * ) Notice: Subject to any disclaimer, the term of this patent is extended or adjusted under 35 U.S.C. 154(b) by 0 days.

(21) Appl. No.: 10/491,113

(22) PCT Filed: Sep. 27, 2002

(86) PCT No.: PCT/AU02/01339

§ 371 (c)(1),
(2), (4) Date: Aug. 12, 2004

(87) PCT Pub. No.: WO03/026548

PCT Pub. Date: Apr. 3, 2003

(65) Prior Publication Data

US 2004/0262055 A1 Dec. 30, 2004

(30) Foreign Application Priority Data

Sep. 27, 2001 (AU) ..... PR 7980

(51) Int. Cl.
*A61G 5/10* (2006.01)
*A61G 5/04* (2006.01)

(52) U.S. Cl. ..... 180/65.1; 180/907; 180/908; 296/65.04; 297/DIG. 4

(58) Field of Classification Search ..... 280/47.4, 280/47.38, 642, 647, 304.1; 180/65.1, 907, 180/908; 296/65.03, 65.04; 297/DIG. 4
See application file for complete search history.

(56) References Cited

U.S. PATENT DOCUMENTS 4,062,209 A * 12/1977 Downing et al. ..... 70/226
4,076,268 A * 2/1978 Hart ..... 296/35.1
4,614,246 A * 9/1986 Masse et al. ..... 180/6.5
5,011,175 A * 4/1991 Nicholson et al. ..... 280/304.1
5,181,762 A 1/1993 Beumer
5,275,248 A * 1/1994 Finch et al. ..... 180/65.6
5,443,239 A * 8/1995 Laporte ..... 248/503.1
5,466,111 A * 11/1995 Meyer ..... 414/462
5,489,170 A * 2/1996 Inoue et al. ..... 410/7
5,707,103 A * 1/1998 Balk ..... 297/13
5,772,237 A * 6/1998 Finch et al. ..... 180/65.1
6,386,614 B1 * 5/2002 Logan ..... 296/65.03

FOREIGN PATENT DOCUMENTS

GB 2275029 8/1994
JP 2001258945 9/2001

* cited by examiner

*Primary Examiner*—Christopher P. Ellis
*Assistant Examiner*—Vaughn Coolman
(74) *Attorney, Agent, or Firm*—Maier & Maier, PLLC

(57) ABSTRACT

A self-propelled wheelchair (1, 101) comprising a frame (2, 102) supporting a seat (3, 103), two drive wheels (5, 105) mounted to the front of the frame, a prime mover mounted to the frame so as to drive the two drive wheels. The wheelchair having at least one castor wheel (7, 107) mounted to the rear of the frame and pivotal about a substantially vertical axis (Y), the frame being height adjustable in such a manner that when the frame is lowered, the seat is simultaneously tilted backwardly. The frame is provided with an anchoring mechanism (116) which allows the wheelchair to be releasably anchored to an anchoring element (119) secured to the floor.

6 Claims, 9 Drawing Sheets

ADJUSTABLE WHEELCHAIR

This Application is a 35 U.S.C. §371 Application of PCT/AU02/01339, filed Sep. 27, 2002.

TECHNICAL FIELD

The present invention relates to a self-propelled wheelchair and in particular to an electric wheelchair having a seat that is height and angle adjustable, and is able to be releasably anchored to the floor of a vehicle.

BACKGROUND

There are many different types of wheelchairs available to handicapped persons who desire mobility and the ability to use motor vehicles. By providing handicapped persons with wheelchairs that can be loaded into a vehicle, they can experience a high degree of mobility and independence. Those handicapped persons who are able to operate wheelchairs usually have the ability to operate vehicles as well, but have great difficulty in entering and exiting vehicles.

There have been many prior art wheelchairs and apparatus for lifting them into and out of automobiles while the handicapped persons remain seated thereon during the movement of the wheelchairs. One such known wheelchair lifting apparatus is shown in U.S. Pat. No. 5,466,111 which discloses a height adjustable wheelchair which is lifted into a vehicle by an apparatus fitted to a side entry door of a vehicle. The vehicle has the driver's seat removed such that the wheelchair sits in front of the steering wheel and locked into place on the floor of the vehicle. There are many other types of wheelchair arrangements which allow a wheelchair to be secured at the driving position however they suffer from a number of disadvantages. They are either difficult to load into vehicles and the seats are not suited to the height and angle requirements of that expected when positioned in the vehicle. In recent times flat floor vans have been modified for use by disabled persons. In order to enter the van a disabled person within a wheelchair generally enters from the rear access door. As the van typically has a substantially flat floor the disabled person is able to manoeuvre the wheelchair to the appropriate driving position near the steering wheel. The wheelchair is typically locked into position by a locking mechanism fitted to the floor of the van. A problem associated with such arrangements is that in order to accommodate the wheelchair, such a van must be of the type that has a relatively high roof. Such vans are typically used for commercial applications and are sometimes not desirable as a passenger vehicle. In recent times a number of vans have come onto the market which have a medium to low roof. Whilst these vans have rear access and a substantially flat floor which is suitable to receive an electric wheelchair, the low to medium height roof makes it difficult for a disabled person to enter the vehicle and then safely drive the vehicle with enough clearance between their head and the roof.

The present invention seeks to provide a wheelchair which has height and seat adjustability to suit the wheelchair for use with various sorts of vehicles.

SUMMARY OF INVENTION

According to one aspect the present invention consists in a self-propelled wheelchair comprising a frame supporting a seat, two drive wheels mounted to the front of said frame, a prime mover mounted to said frame so as to drive said two drive wheels, and at least one castor wheel mounted to the rear of said frame and pivotal about a substantially vertical axis, said frame is height adjustable in such a manner that when said frame is lowered, said seat is simultaneously tilted backwardly, characterised in that said frame is provided with an anchoring mechanism which allows said wheelchair to be releasably anchored to an anchoring element secured to the floor.

Preferably in one embodiment said anchoring mechanism comprises at least one anchoring member located on the lower portion of said frame, and the anchoring element comprises at least one anchoring projection which projects upwardly therefrom and is adapted to engage with said anchoring member when said frame is moved downwardly and laterally restrained by forward movement of the wheelchair. Preferably said anchoring projection has a recess thereon adapted to engage with said anchoring member.

Preferably in another embodiment said anchoring mechanism comprises two pairs of anchoring members located on the lower portion of said frame, the first pair of anchoring members located at or near the front of said frame and the second pair of anchoring members located at or near the rear of said frame and the anchoring element comprises at least one anchoring projection which projects upwardly therefrom and is adapted to engage with said anchoring member when said frame is moved downwardly and laterally restrained by forward movement of the wheelchair. Preferably said anchoring mechanism comprises anchoring projections which project downwardly from said frame and are adapted to engage within openings on said anchoring element when said frame is moved downwardly and laterally restrained by forward movement of the wheelchair.

Preferably the anchoring mechanism comprises a locking pin mechanism adapted to engage with a locking aperture.

Preferably said locking pin mechanism is located on said frame and said locking aperture is located on said anchoring element.

Preferably said anchoring element is removably secured to the floor of a vehicle.

Preferably said anchoring element is adapted to be removably secured to the anchoring points provided for a vehicle seat.

MODE OF CARRYING OUT INVENTION

Figure 1:
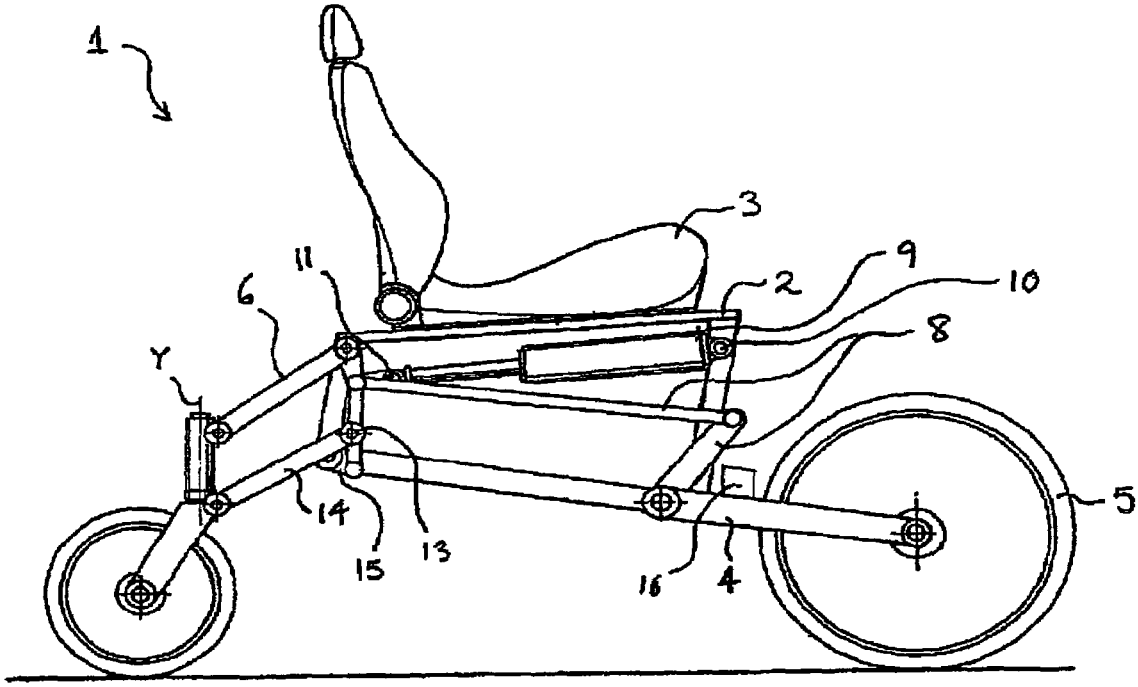
FIG. 1 is an elevational view of an embodiment of a wheelchair adapted to be lowered and raised in a fully raised upright position.
Figure 2:
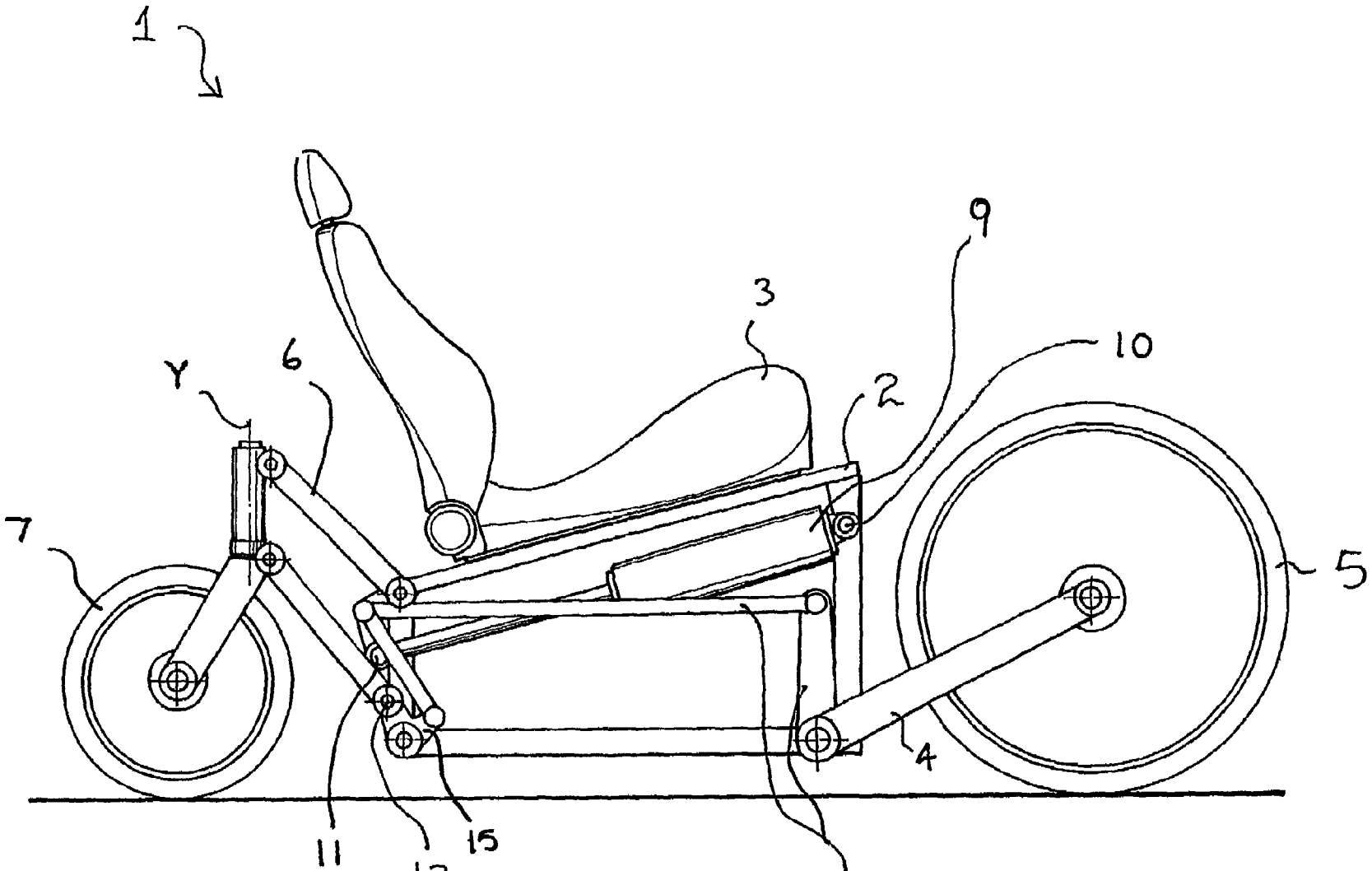
FIG. 2 is an elevational view of the wheelchair shown in FIG. 1 in a lowered and inclined position.

FIGS. 1 and 2 illustrate, in a simplified schematic figure, the components of a self-propelled wheelchair 1. The self-propelled wheelchair 1 is preferably of the type incorporating electrically driven prime movers. For reasons of clarity, the self-propelled wheelchair 1 is shown in schematic view with the detail of the prime mover, batteries and drive mechanism removed, and only details of the frame, wheels, linkage mechanism and seat is shown. Various supports, bearings and control units, well known to those skilled in the art have been omitted from the Figures.

The self-propelled wheelchair 1 comprises a main frame 2 supporting a seat 3. The front of the frame 2 has a swing arm 4 to which the drive wheels 5 (only one of which is shown) and motors, for example prime mover 16, are attached. At the rear of frame 2 is attached a parallelogram linkage mechanism 6 to which two castor wheels 7 (only one of which is shown) are mounted. The swing arm 4 and the parallelogram linkage mechanism 6 are connected by transfer rods 8. An electrically powered linear actuator 9 is connected to the front of frame 2 at location 10 and connected to the parallelogram, linkage mechanism 6 at location 11. Extending linear actuator 9 results in the lowering of frame 2. As this occurs, the parallelogram linkage mechanism 6 changes orientation whilst ensuring that the substantially vertical axis Y about which the castor wheels 7 pivot remains substantially vertical. In order to maintain axis Y substantially vertical, the lower arm 14 of the parallelogram linkage mechanism 6 decreases its length as the frame 2 rises and increases its length as the frame 2 is lowered. This is achieved by rotatably changing the position of the pivot point 13 on the lower arm 14 of the parallelogram linkage mechanism 6 as shown in FIG. 2, to a different orientation as shown in FIG. 1. This occur by rotation of rotatable linkage member 15 as linear actuator 9 is extended and retracted.

A first embodiment of a wheelchair in accordance with the invention is shown in FIGS. 3–8. The self-propelled wheelchair 101 comprises a main frame 102 supporting a seat 103. The front of frame 102 has a swing arm 104 to which drive wheels 105 (only one of which is shown) motors (not shown) are attached. At the rear of frame 102 is attached a parallelogram linkage mechanism 106 to which castor wheels 107 (only one of which is shown) are mounted. Swing arm 104 and parallelogram linkage mechanism 106 are connected by transfer rods 108. An electrically powered linear actuator (not shown but similar to the actuator 9 the wheelchair shown in FIG. 1 is connected to the front of the frame 102 and connected at a rearward location to parallelogram linkage mechanism 106. In a similar fashion to the wheelchair shown in FIGS. 1–2, actuation of the linear actuator allows frame 102 to be lowered. As this occurs parallelogram linkage mechanism 106 changes orientation whilst ensuring that substantially vertical axis Y' about which castor wheels 107 pivot remains substantially vertical. Lower linkage member 115 is provided with anchoring projections 116, with disk heads 117.

Wheelchair 101 may be lowered to enter a van having a medium to low roof clearance. Floor 118 of the van would have an anchoring element (or plate) 119 fitted thereto. Anchoring element 119 has elongate openings 120, each of which has a large aperture 121 and a narrow slot 122 projecting therefrom parallel to longitudinal axis L of anchoring plate 119.

Figure 6:
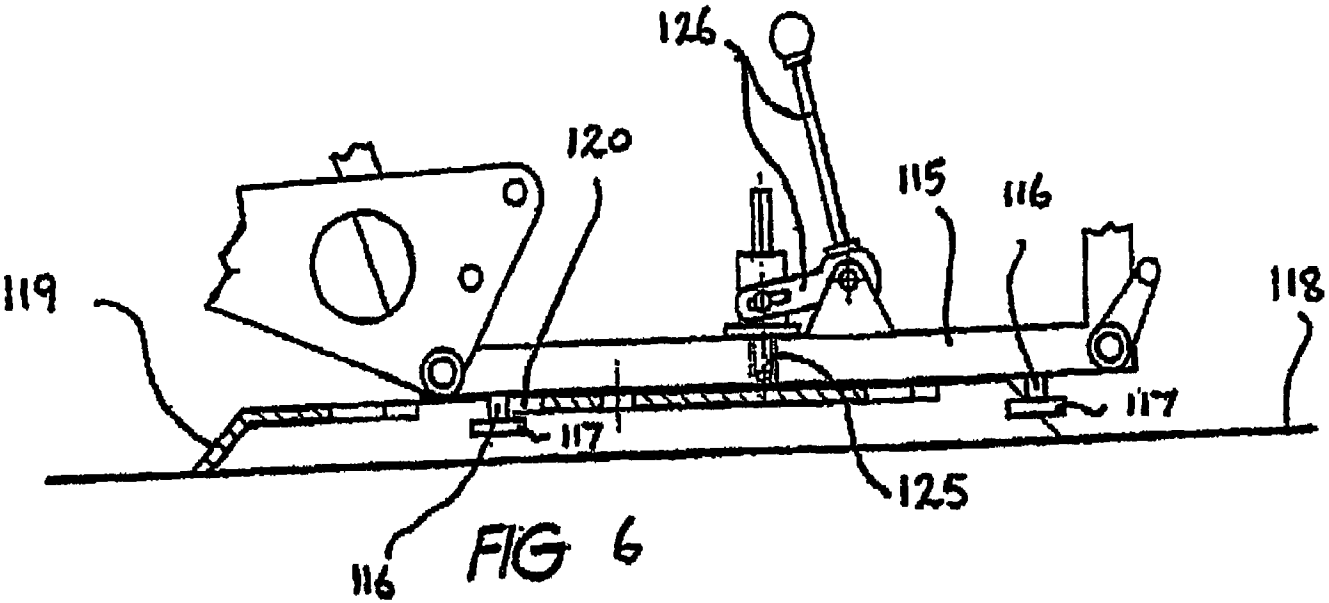
FIG. 6 is a partial elevational view of the wheelchair shown in FIG. 4, as the anchoring projections are lowered into the anchoring element.
Figure 7:
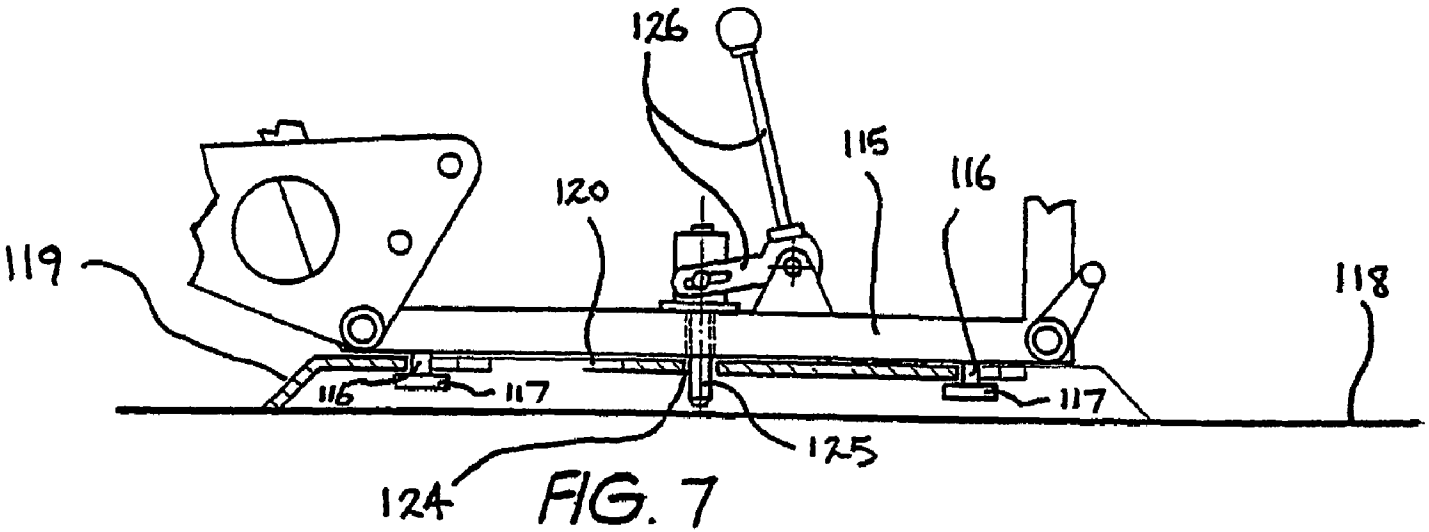
FIG. 7 is a partial elevational view of the wheelchair shown in FIG. 6 moved forwardly such that a locking pin engages with the anchoring element and prevents the wheelchair from any substantial movement.
Figure 8:
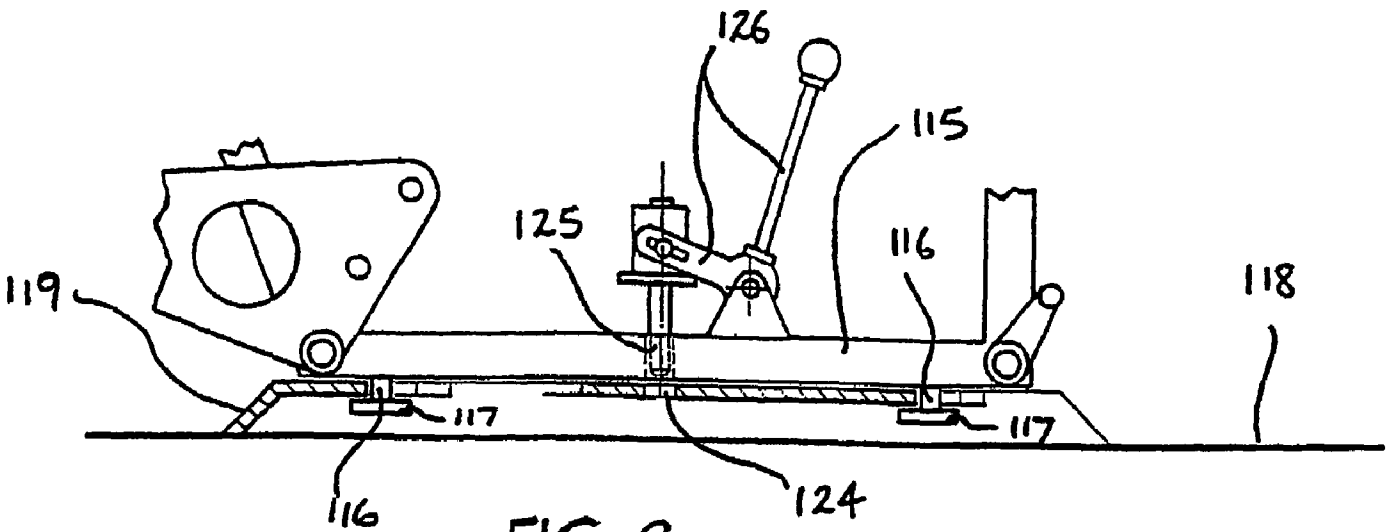
FIG. 8 is a partial elevational view of the wheelchair shown in FIG. 7 where the locking pin has been actuated for release of the wheelchair.

In use, wheelchair 101 is manoeuvred into the van and over anchoring element 119, such that disk heads 117 of anchoring projections 116 are aligned with respective large apertures 121 of the elongate openings 120. Wheelchair 101 can then be lowered such that disk heads 117 of anchoring projections 116 are lowered into the respective large sections 121, as shown in FIG. 6. Wheelchair 101 may then be manoeuvred forwardly such that projections 116 are move into respective narrow slots 122, and locking pin 125 may engage with locking aperture 124 and prevent further forward or rearward movement of wheelchair 101. The minimal clearance between projections 116 and the respective narrow slots 122, ensures that no significant sideway movement can be made to wheelchair 101 relative to floor 118 of the van. A manually operated linkage mechanism 126 is used to allow locking pin 125 to be withdrawn from locking aperture 124.

For ease of clarity manually operated linkage mechanism 126 and locking pin 125 have been shown in simplified form, however, more preferably in a not shown embodiment, locking pin 125 may be biased downwardly to automatically enter locking aperture 124 as wheelchair 101 is manoeuvred such that projections 116 are move forwardly into respective narrow slots 122. In such an embodiment manually operated linkage mechanism 126 is used only to disengage locking pin 125 from locking aperture 124.

In an alternative embodiment, manually operated linkage mechanism 126 may be replaced by an electrically operated pin mechanism, which is preferably provided with a manually operated override, such that the pin 125 can be released both electrically and mechanically.

Figure 3:
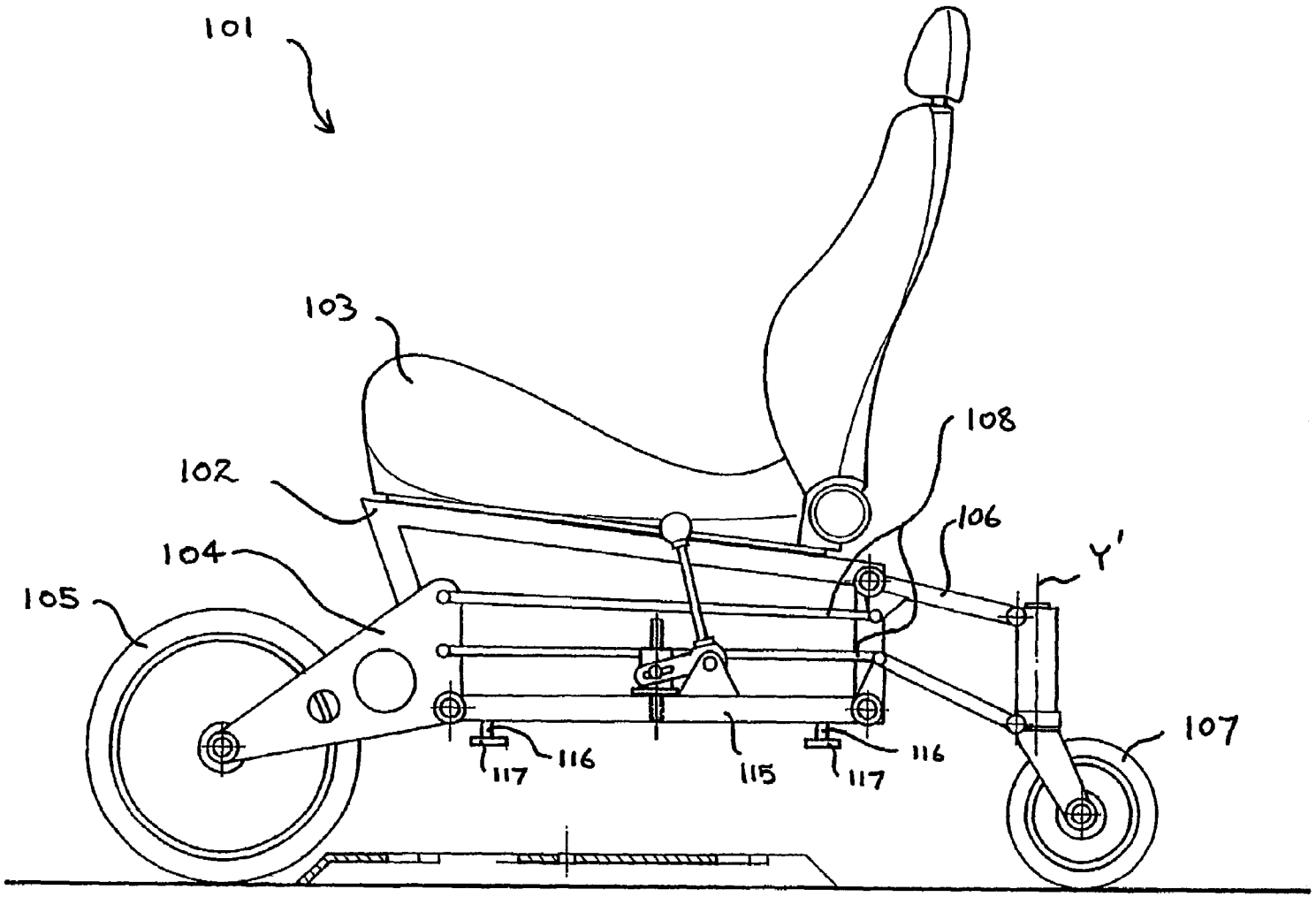
FIG. 3 is an elevational view of a first embodiment of a wheelchair in accordance with the present invention in a fully raised and upright position.
Figure 4:
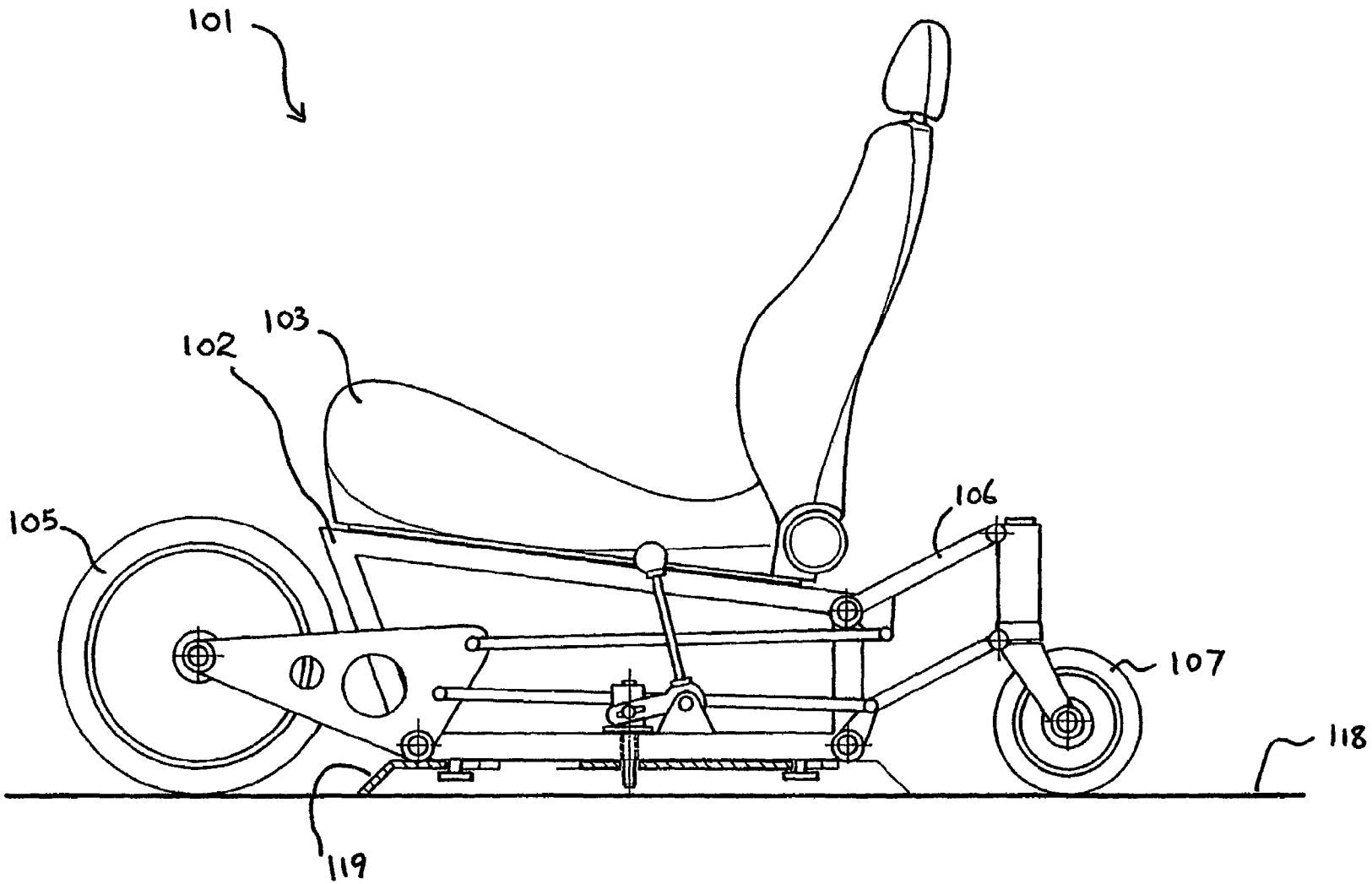
FIG. 4 is a elevational view of the wheelchair shown in FIG. 3 in a lowered and inclined position.
Figure 5:
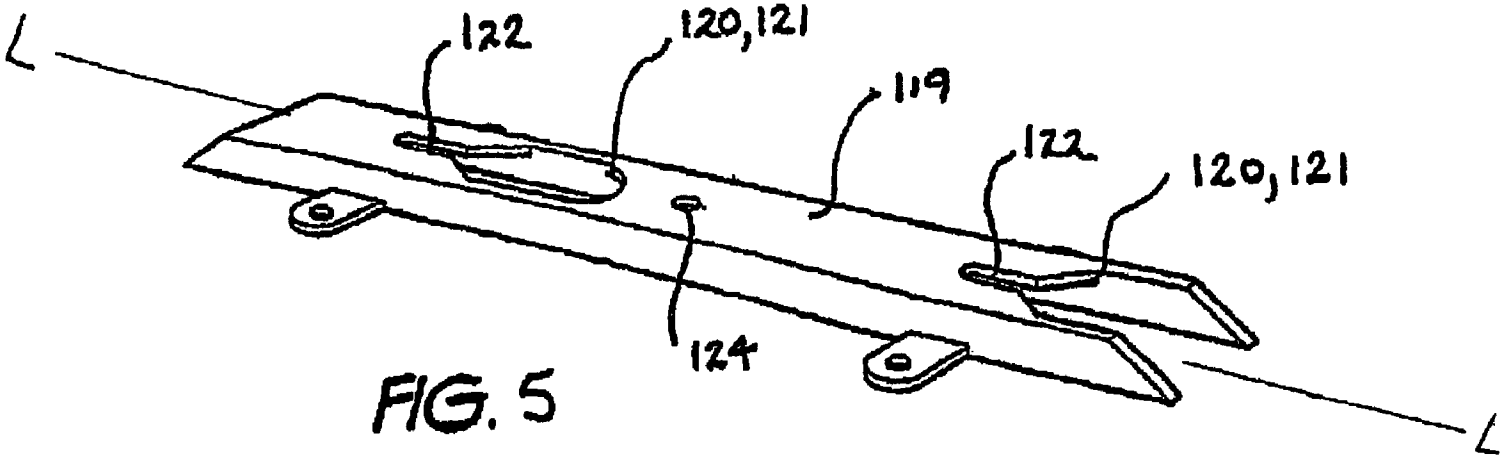
FIG. 5 is a perspective view of an anchoring element to be secured to the floor of a van for use with the wheelchair shown in FIG. 3.

The wheelchair 101 of the present invention has the following advantages. In the upright position as shown in FIG. 3, the wheelchair maintains standard wheelchair features and is able to be propelled by a disabled operator in a conventional manner. In the lowered position as shown in FIG. 4, the operator is placed in a situation suitable for automotive transport i.e. not only is the wheelchair frame 102 and seat 103 lowered in order to allow a disabled operator to enter a van having a medium to low roof clearance and to be releasably anchored to floor 118 of the van, it also is simultaneously inclined for use in the driving position of the vehicle. It should be understood that whilst the wheelchair 101 is shown in a fully raised/upright position in FIG. 3 and a fully lowered/inclined position in FIG. 4, the wheelchair 101 can be operated safely at any height between the fully lowered and fully raised positions making it suitable for multiple applications, i.e. for use at workstations, tables in restaurants, desks etc. Also, it should be understood that the self-propelled wheelchair 101 of the present invention will accept virtually any seat type including automotive and custom made seats which may be necessary for the individual disabled operator. The seat 103 can be easily replaced as it would preferably be attached to the frame 102 by conventional threaded fasteners.

Figure 9:
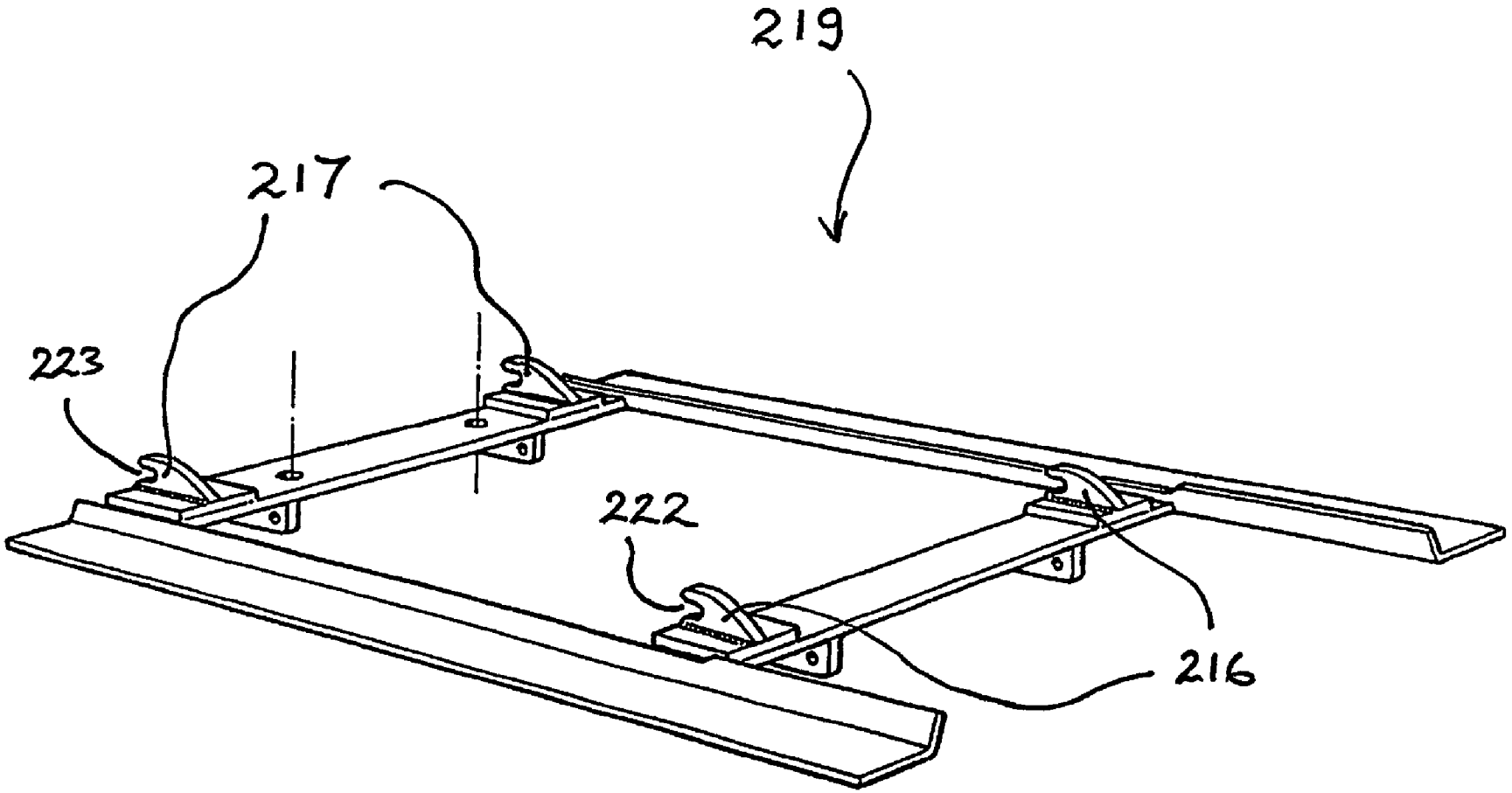
FIG. 9 is a perspective view of the anchoring element for use with a second embodiment of a wheelchair in accordance with the present invention.
Figure 10:
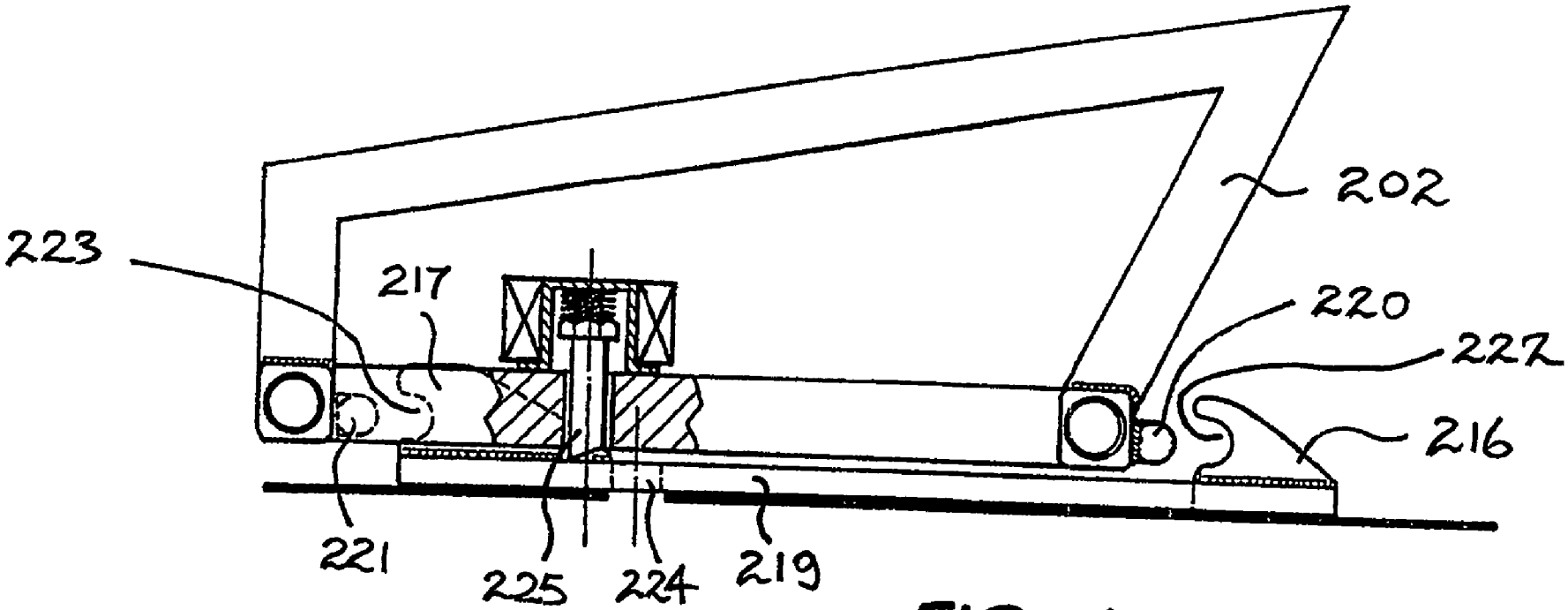
FIG. 10 is a partial elevation view of the lower frame portion of a second embodiment of the wheelchair in accordance with the present invention in a lowered position prior to engagement with the anchoring element of FIG. 9.
Figure 11:
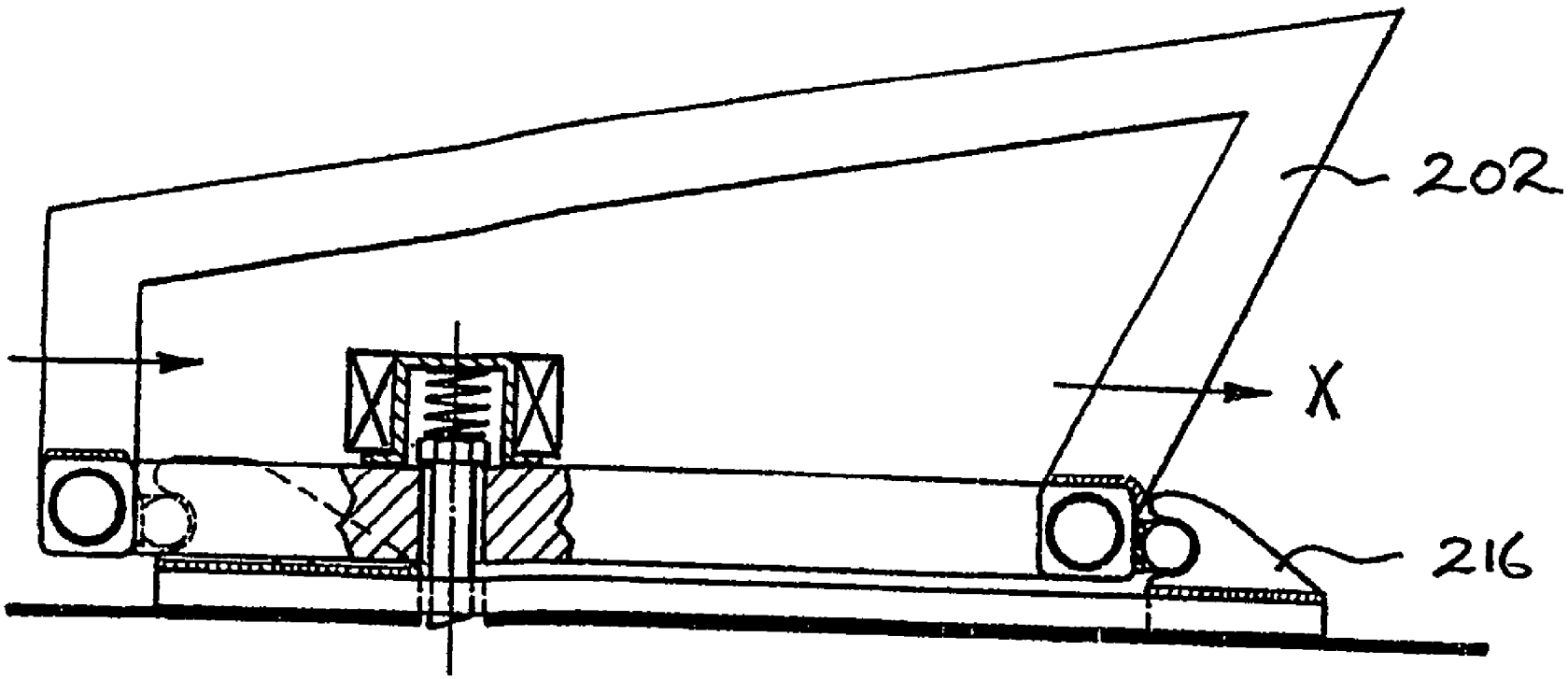
FIG. 11 is a partial elevation view of the lower frame portion of the second embodiment of the wheelchair shown in FIG. 10 in engagement with the anchoring element.

FIGS. 9–11 depict a partial view of second embodiment of wheelchair in accordance with the present invention and its respective anchoring element 219. For ease of clarity only the lower portion of frame 202 of the wheelchair is shown. It should be understood that in this embodiment of the wheelchair the frame 202 may be lowered and the seat (not shown) is simultaneously tilted backward in a like manner to the wheelchair shown in FIGS. 1–2 and in the first embodiment of the present invention shown in FIGS. 3–8.

In this second embodiment the anchoring element 219 has two pairs of anchoring projections 216, 217 projecting upwardly therefrom. The first pair of anchoring projections 216 are spaced apart from each other and located at the front of the anchoring element 219. The second pair of anchoring projections 217 are spaced apart from each other and located at the rear of anchoring element 219.

The lower portion of frame 202 has two pairs of anchoring members 220 and 221 that correspond to the respective first and second pairs of anchoring projections 216, 217. In FIGS. 10 and 11, only one anchoring member 220 and respective anchoring projection 216 is shown, and only one anchoring member 221 and its respective anchoring projection 217 is shown. The anchoring members 220, 221 preferably are short rod members fixed to frame 202.

In use the wheelchair frame 202 is fully lowered as the wheelchair moves in direction X such that the anchoring members 220, 221 engage with recesses 222, 223 in respective anchoring projections 216, 217.

A locking pin 225 located on frame 202 is biased downwardly to automatically enter locking aperture 224 on anchoring element 219. The locking pin is retractable by an electrically operated solenoid mechanism but may alternatively in a further embodiment be manually retractable as described for the first embodiment.

A wheelchair in accordance with the second embodiment of the present invention has similar advantages to that of the first embodiment as described earlier.

It should be understood that in both of the first and second embodiments described above it is preferable to adapt anchoring elements 119 and 219 such that they may be removably secured to the same anchoring points in a van (vehicle) to which a removable seat (not shown) is anchored.

An advantage of the abovementioned embodiment is that the self-propelled wheelchair minimises the need for extensive modification to various vehicles and allows access to a broader range of vehicles for disabled operators and/or passengers.

What is claimed is:

1. A self-propelled wheelchair, comprising:

a frame supporting a seat, two drive wheels mounted to the front of said frame, a prime mover mounted to said frame so as to drive said two drive wheels, and at least one castor wheel mounted to the rear of said frame and pivotal about a substantially vertical axis, said frame is height adjustable in such a manner that when said frame is lowered, said seat is simultaneously tilted backwardly, said frame is provided with an anchoring mechanism which allows said wheelchair to be releasably anchored to an anchoring element secured to the floor, said anchoring element comprises at least one anchoring projection which projects upwardly therefrom and is adapted to engage with said anchoring mechanism when said frame is moved downwardly and laterally restrained by forward movement of the wheelchair, wherein the anchoring mechanism further comprises a locking pin mechanism, mounted on the side of said frame, said locking pin mechanism having a retractable locking pin biased to automatically enter a locking aperture when said anchoring mechanism is brought into engagement with said anchoring element, and said locking pin may be retracted by an operation performed by a poison seated within said wheelchair.

2. A self-propelled wheelchair as in claim 1, wherein said locking pin is manually retractable.

3. A self-propelled wheelchair as in claim 1, wherein said locking pin is retractable by an electrically operated solenoid mechanism.

4. A self-propelled wheelchair as in claim 1, wherein said locking aperture is located on said anchoring element.

5. A self-propelled wheelchair as in claim 1, wherein said anchoring element is removably secured to a floor of a vehicle.

6. A self-propelled wheelchair as in claim 5, wherein said anchoring element is adapted to be removably secured to the anchoring points provided for a vehicle seat.

* * * * *